US005726003A

United States Patent [19]

Zengerle et al.

[11] Patent Number: 5,726,003

[45] Date of Patent: Mar. 10, 1998

[54] CYAN COUPLER DISPERSION WITH INCREASED ACTIVITY

[75] Inventors: Paul Leo Zengerle; Allan Francis Sowinski, both of Rochester, N.Y.

[73] Assignee: Eastman Kodak Company, Rochester, N.Y.

[21] Appl. No.: 698,079

[22] Filed: Aug. 15, 1996

[51] Int. Cl.[6] ..... G03C 7/34

[52] U.S. Cl. ..... 430/546; 430/552; 430/553

[58] Field of Search ..... 430/552, 553, 430/546

[56] References Cited

U.S. PATENT DOCUMENTS

| | | | |
|---|---|---|---|
| 2,801,170 | 7/1957 | Vittum et al. | 96/97 |
| 2,801,171 | 7/1957 | Fierke et al. | 430/546 |
| 3,619,195 | 11/1971 | VanCampen | 96/100 |
| 3,880,661 | 4/1975 | Lau et al. | 96/55 |
| 3,936,303 | 2/1976 | Shiba et al. | 96/74 |
| 4,080,209 | 3/1978 | Mukunoki et al. | 96/76 R |
| 4,146,399 | 3/1979 | Trunley et al. | 430/546 |
| 4,205,990 | 6/1980 | Deguchi et al. | 430/380 |
| 4,304,844 | 12/1981 | Fujimatsu et al. | 430/384 |
| 4,333,999 | 6/1982 | Lau | 430/17 |
| 4,419,441 | 12/1983 | Nittel et al. | 430/377 |
| 4,474,872 | 10/1984 | Onishi et al. | 430/512 |
| 4,551,422 | 11/1985 | Kimura et al. | 430/553 |
| 4,609,619 | 9/1986 | Katoh et al. | 430/553 |
| 4,885,234 | 12/1989 | Zengerle | 430/546 |
| 4,923,783 | 5/1990 | Kobayashi et al. | 430/553 |
| 5,008,179 | 4/1991 | Chari et al. | 430/546 |
| 5,015,564 | 5/1991 | Chari | 430/546 |
| 5,089,380 | 2/1992 | Bagchi | 430/449 |
| 5,112,729 | 5/1992 | Mihayashi | 430/546 |
| 5,162,197 | 11/1992 | Aoki et al. | 430/546 |
| 5,173,398 | 12/1992 | Fukazawa et al. | 430/546 |
| 5,298,386 | 3/1994 | Czekai | 430/569 |
| 5,300,419 | 4/1994 | Seto et al. | 430/551 |
| 5,342,746 | 8/1994 | Zengerle et al. | 430/546 |
| 5,356,768 | 10/1994 | Bertramini et al. | 430/546 |
| 5,370,978 | 12/1994 | Takahashi | 430/505 |
| 5,451,496 | 9/1995 | Merkel et al. | 430/553 |

FOREIGN PATENT DOCUMENTS

| | | | |
|---|---|---|---|
| 097 042 | 12/1983 | European Pat. Off. . | |
| 102 839 | 3/1984 | European Pat. Off. . | |
| 289 820 | 11/1988 | European Pat. Off. . | |
| 361 924 | 4/1990 | European Pat. Off. . | |
| 389 817 | 10/1990 | European Pat. Off. . | |
| 434028 | 12/1990 | European Pat. Off. . | |
| 0 486 929 A1 | 5/1992 | European Pat. Off. . | |
| 502531 | 9/1992 | European Pat. Off. . | |
| 553 964 | 8/1993 | European Pat. Off. . | |
| 570 973 | 11/1993 | European Pat. Off. . | |
| 639790 | 2/1995 | European Pat. Off. . | |
| 144129 | 9/1980 | German Dem. Rep. . | |
| 3624777 | 1/1988 | Germany . | |
| 3700570 | 7/1988 | Germany . | |
| 3936300 | 5/1991 | Germany . | |
| 0106228 | 8/1979 | Japan | 430/546 |
| 2247364 | 10/1987 | Japan | 430/546 |
| 2247365 | 10/1987 | Japan | 430/546 |
| 63/201647 | 8/1988 | Japan . | |
| 3226654 | 9/1988 | Japan | 430/553 |
| 6067380 | 3/1994 | Japan | 430/552 |
| 820 329 | 9/1959 | United Kingdom . | |
| 1077426 | 7/1967 | United Kingdom . | |
| 1099417 | 1/1968 | United Kingdom . | |
| 1207529 | 10/1970 | United Kingdom . | |
| 1222753 | 2/1971 | United Kingdom . | |
| 1344154 | 1/1974 | United Kingdom . | |
| 1346425 | 2/1974 | United Kingdom . | |
| 1370151 | 10/1974 | United Kingdom . | |
| 93/03420 | 2/1993 | WIPO . | |

*Primary Examiner*—Janet C. Baxter
*Attorney, Agent, or Firm*—Andrew J. Anderson

[57] ABSTRACT

Silver halide photographic light-sensitive elements comprising a support having coated thereon a coupler dispersion containing layer comprising phenolic cyan dye forming couplers of Formula I and a high boiling organic solvent of Formulas II–V as defined in the specification, wherein the weight ratio in said layer of solvent of formulas II–V relative to coupler of formula I is from 0.1 to 0.5. Such elements provide relatively high cyan coupler reactivity to obtain satisfactory cyan dye density upon processing of the photographic material.

Formula I

Formula II

Formula III

Formula IV

Formula V

21 Claims, No Drawings

CYAN COUPLER DISPERSION WITH INCREASED ACTIVITY

FIELD OF THE INVENTION

This invention relates to silver halide photographic materials and methods of making such materials, and more specifically to photographic materials comprising dispersions of specific phenolic cyan dye-forming photographic couplers and limited amounts of specific high boiling organic solvents.

BACKGROUND OF THE INVENTION

In the design of silver halide light-sensitive multilayer photographic materials, it is desirable to minimize the dry thickness of the coated layers. Layer thinning is advantageous for reasons such as improved image sharpness due to reduced light scattering during exposure and increased developability due to shorter diffusion paths through the multilayer structure. This increase in developability can lead to lower silver and/or coupler coated levels, hence lower materials cost.

Photographic dye-forming couplers, as well as other hydrophobic photographically useful compounds, are generally incorporated into a layer of a photographic element by first forming an aqueous dispersion of the couplers and then mixing such dispersion with the layer coating solution. An organic solvent is generally used to dissolve the coupler, and the resulting organic solution is then dispersed in an aqueous medium to form the aqueous dispersion.

The organic phase of these dispersions frequently includes high-boiling or permanent organic solvents. Permanent high boiling solvents have a boiling point sufficiently high, generally above 150° C. at atmospheric pressure, such that they are not evaporated under normal dispersion making and photographic layer coating procedures. Permanent high-boiling coupler solvents are primarily used in the conventional "oil-protection" dispersion method whereby the organic solvent remains in the dispersion, and thereby is incorporated into the emulsion layer coating solution and ultimately into the photographic element.

In order to reduce the coated thickness of photographic layers, it is essential to minimize the amount of permanent coupler solvent coated in the element. In fact, reductions in coupler solvent level also afford concomitant reductions in gelatin level which leads to further reductions in coated dry thickness. U.S. Pat. No. 5,173,398, e.g., discloses photographic elements with coupler-containing layers having substantially no high-boiling solvent, wherein the couplers are incorporated in the layer in the form of precipitated dispersions. However, coupler solvent reduction can also result in excessive crystallization of the dispersed organic compounds in an aqueous dispersion or coating solution with photographic compounds that have a tendency to crystallize. These crystallization problems can cause filter-plugging during the manufacture of photographic materials or may result in physical defects in the coated product. Another difficulty with coupler solvent reduction is that the reactivity of the dispersed photographically useful chemical, such as a dye-forming coupler, may be reduced to a level too low to produce desired dye density upon processing of the photographic material.

Dispersions of photographic couplers made without using permanent coupler solvent are well-known in the art. Such dispersions are generally made with auxiliary solvents which are removed from the dispersion prior to coating.

Auxiliary solvents may be water immiscible, volatile solvents, or solvents with limited water solubility which are not completely water miscible. In fact, there are many photographic compounds which can be dispersed with or without permanent solvent with no crystallization problems, as noted in U.S. Pat. No. 2,801,170. However, when the dispersed photographic compound is prone to crystallization, the tendency to crystallize generally becomes greater as the amount of coupler solvent, relative to coupler, is decreased, as noted in U.S. Pat. Nos. 4,419,441 and 5,112,729, and copending, commonly assigned U.S. Pat. application Ser. No. 08/409,368 filed Mar. 23, 1995.

Phenolic cyan dye forming couplers are well-known in the art, and are known to be very prone to crystallization. Due to their crystalline nature, these couplers are often dispersed as mixtures of two or more couplers to avoid crystallization problems, as described in U.S. Pat. No. 4,885,234 and EP 434,028.However, use of these methods requires the synthesis of an additional photographic coupler which results in an increase in manufacturing cost. In order to achieve adequate coupler reactivity, phenolic cyan dye-forming couplers are commonly dispersed with high-boiling organic solvents as described in U.S. Pat. Nos. 4,333,999, 4,609,619, EP 097,042, EP 102,839, EP 389,817, DE 3,624,777, DE 3,700,570, and DE 3,936,300.It is also well-known, as mentioned in U.S. Pat. No. 2,801,170, that coupler solvent reduction can result in reduced coupler reactivity. This reference also teaches the concept of combining a solvent-free coupler dispersion with a dispersion of a high boiling coupler solvent.

U.S. Pat. No. 5,112,729 describes a photographic material containing a cyan naptholic coupler and a high-boiling solvent present in a weight ratio with respect to the coupler in the layer of not more than 0.3.While a variety of possible solvents is disclosed, the use of a phosphoric acid ester and a phthalic acid ester is said to be preferred for use with these couplers. Methods of increasing the dye yield of oil-free cyan coupler dispersions are disclosed in Research Disclosure 14532 (May, 1976). The specific cyan couplers described in these references fall outside the scope of the present invention. Crystallization of phenolic cyan couplers is also discussed in EP 361,924.

It has recently been found that solvent-free dispersions of specific phenolic cyan couplers are actually more stable than those containing coupler solvent as described in the aforementioned patent application 08/409,368.But these no-solvent dispersions still suffer from relatively low coupler reactivity, yielding lower than desired dye density upon processing the photographic material when used in coupler-rich multilayer structures.

It is therefore desirable to provide silver halide photographic elements made from solvent-free dispersions of specific phenolic cyan couplers which exhibit improved stability to crystallization, while achieving high coupler reactivity in the photographic material to obtain adequate dye density upon processing. It is further desirable to achieve a reduction in the coated level of coupler solvent to decrease coated dry thickness. It is toward these ends that the present invention is directed.

SUMMARY OF THE INVENTION

An object of the present invention is to provide a silver halide photographic light-sensitive material with reduced coated dry thickness. Another object of the present invention is to provide a silver halide photographic material having high cyan coupler reactivity to obtain satisfactory cyan dye density upon processing of the photographic material. A further object of the invention is to provide photographic materials possessing such properties which are made from cyan coupler dispersions with improved stability to crystallization following extended cold storage.

These and other objects of the present invention are attained by providing a silver halide photographic light-sensitive material comprising a support having coated thereon a coupler dispersion containing layer comprising a specific class of phenolic cyan dye forming couplers and a limited amount of specific high boiling organic solvents.

In accordance with one embodiment of the invention, a method of making a silver halide color photographic light sensitive material is disclosed comprising:

(a) preparing a first dispersion of a phenolic cyan coupler of Formula I dispersed in an aqueous medium;

Formula I

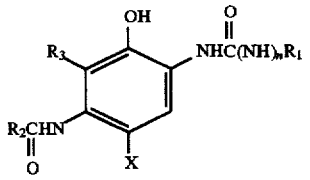

wherein $R_1$ and $R_2$ each represent an aliphatic group, an aromatic group, or a heterocyclic group, $R_3$ represents a hydrogen atom, a halogen atom, an aliphatic group, or an acylamino group, X represents a hydrogen atom or a group capable of being released upon a coupling reaction with oxidation product of a developing agent, and n represents 0 or 1;

(b) preparing a second dispersion of a high-boiling organic solvent having Formula II, III, IV, V or combinations thereof dispersed in an aqueous medium:

$$R_4-(CH_2)_m-R_5$$ Formula II wherein $R_4$ and $R_5$ each represent an alkoxycarbonyl group containing not more than 8 carbon atoms, and m is an integer from 1 to 10;

Formula III

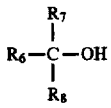

wherein $R_6$ represents an alkyl group or an alkenyl group, and $R_7$ and $R_8$ are individually selected from hydrogen and the group of moieties from which $R_6$ is selected, provided that the total number of carbon atoms contained in $R_6$, $R_7$, and $R_8$ is at least 10;

Formula IV

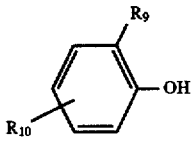

wherein $R_9$ and $R_{10}$ are hydrogen or straight chain or branched chain alkyl groups, at least one of $R_9$ or $R_{10}$ being a straight chain or branched chain alkyl group, the total number of carbon atoms in $R_9$ plus $R_{10}$ being from 9 to 20, and $R_{10}$ being in the para or meta position with respect to the phenolic hydroxyl group;

Formula V

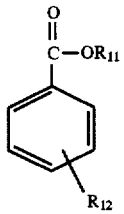

wherein $R_{11}$ represents an aliphatic group, an aromatic group, or a heterocyclic group, and $R_{12}$ represents a hydrogen atom, a hydroxy group, an alkoxy group, or an aliphatic group;

(c) combining said first and second dispersions in an aqueous coating solution, wherein the weight ratio in said coating solution of high-boiling organic solvent of formula II, III, IV and V relative to coupler of formula I is from 0.1 to 0.5; and (d) coating said coating solution on a photographic support.

In a preferred embodiment of the invention, the first dispersion of cyan coupler of Formula I is substantially free of permanent organic solvent, and is formed by dissolving a coupler of Formula I in an auxiliary solvent, dispersing the auxiliary solvent and dissolved coupler in an aqueous gelatin solution, and removing the auxiliary solvent from the dispersion.

In accordance with another embodiment of the invention, a silver halide color photographic light sensitive material is disclosed comprising a support bearing a layer comprising a coupler of formula I and a high-boiling organic solvent of formula II, III, IV or V, wherein the weight ratio in said layer of high-boiling organic solvent of formula II, III, IV or V relative to coupler of formula I is from 0.1 to 0.5.

Advantages

With the present invention, it is possible to produce a silver halide light-sensitive photographic material which employs specific phenolic cyan couplers with a minimal level of high-boiling organic solvent to reduce coated dry thickness while maintaining high coupler reactivity to obtain adequate dye density upon processing the photographic material and avoiding coupler crystallization problems exhibited by low solvent dispersions of these couplers.

The coupler solvents employed in the present invention have unexpectedly been found to provide relatively higher coupler reactivity with specific phenolic cyan couplers at low levels of coupler solvent. It has also been found that dispersing the cyan couplers of the present invention in low levels of the coupler solvents of the present invention may lead to severe crystallization problems. However, these problems are avoided by preparing separate dispersions of these cyan couplers and of the high-boiling organic solvents, and then combining such dispersions in a coating solution.

DETAILED DESCRIPTION OF THE INVENTION

In the cyan coupler represented by Formula I, $R_1$ and $R_2$ each represents an aliphatic group (preferably an aliphatic group having from 1 to 32 carbon atoms, e.g., methyl, butyl, dodecyl, cyclohexylallyl), an aryl group (e.g., phenyl, naphthyl) or a heterocyclic group (e.g., 2-pyridyl, 2-imidazolyl, 2-furyl, 6-quinolyl). It is understood throughout this specification that any reference to a substituent by the identification of a group containing a substitutable hydrogen, unless otherwise specifically stated, shall encompass not only the substituent's unsubstituted form, but also its form substituted with any other photographically useful substituents. For example, each such substitutable group can be substituted with one or more photographically acceptable substituents, such as those selected from an alkyl group, an aryl group, a heterocyclic group, an alkoxy group (e.g., methoxy, 2-methoxyethoxy), an aryloxy group (e.g., 2,4-di-tert-amyl phenoxy, 2-chlorophenoxy, 4-cyanophenoxy), an alkenyloxy group (e.g., 2-propenyloxy), an acyl group (e.g., acetyl, benzoyl), an ester group (e.g., butoxycarbonyl, phenoxycarbonyl, acetoxy, benzoyloxy, butoxysulfonyl, toluenesulfonyloxy), an amido group (e.g., acetylamino, methanesulfonylamino, dipropylsulfamoylamino), a carbamoyl group (e.g., dimethylcarbamoyl, ethylcarbamoyl), a sulfamoyl group (e.g., butylsulfamoyl), an imido group (e.g., succinimido, hydantoinyl), a ureido group (e.g., phenylureido, dimethylureido), an aliphatic or aromatic sulfonyl group (e.g., methanesulfonyl, phenylsulfonyl), an aliphatic or aromatic thio group (e.g., ethylthio, phenylthio), a hydroxy group, a cyano group, a carboxy group, a nitro group, a sulfo group, and a halogen atom. Usually the substituent will have less than 30 carbon atoms and typically less than 20 carbon atoms.

$R_3$ represents a hydrogen atom, a halogen atom, an aliphatic group, an aromatic group, or an acylamino group.. When $R_3$ in Formula I represents a substituent which can be substituted per se, it may be further substituted with one or more substituents selected from those as described for $R_1$ and $R_2$ above.

In Formula I, X represents a hydrogen atom or a coupling off group capable of being released upon coupling. Examples of the groups capable of being released upon coupling include a halogen atom (e.g., fluorine, chlorine, bromine), an alkoxy group (e.g., ethoxy, dodecyloxy, methoxycarbamoylmethoxy, carboxypropyloxy, methylsulfonylethoxy) an aryloxy group (e.g., 4-chlorophenoxy, 4-methoxyphenoxy, 4-carboxyphenoxy), an acyloxy group (e.g., acetoxy, tetradecanoyloxy, benzoyloxy), a sulfonyloxy group (e.g., methanesulfonyloxy, toluenesulfonyloxy), an amido group (e.g., dichloroacetylamino, heptafluorobutyrylamino, methanesulfonylamino, toluenesulfonylamino), an alkoxy carbonyloxy group (e.g., ethoxycarbonyloxy, benzyloxycarbonyloxy), an aryloxycarbonyloxy group (e.g., phenoxycarbonyloxy), an aliphatic or aromatic thio group (e.g., ethylthio, phenylthio, tetrazolythio, mercaptopropionic acid), an imido group (e.g., succinimido, hydantoinyl), a sulfonamido group and an aromatic azo group (e.g., phenylazo). These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference. These groups may contain a photographically useful group.

In Formula I, $R_1$ is preferably an aryl group or a heterocyclic group. More preferred is an aryl group substituted with one or more substituents selected from a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group and a cyano group. Most preferred is an aryl group substituted with one or more halogen or cyano substituents.

In Formula I, $R_2$ is preferably an alkyl group or an aryl group, more preferably an alkyl group substituted with an aryloxy group, and $R_3$ is preferably a hydrogen atom. X is preferably a hydrogen atom, a halogen atom, an alkoxy group, an aryloxy group, an acyloxy group or a sulfonamido group. Also preferred is where n is 1.

In a preferred embodiment of the invention, n is 1, and X is hydrogen atom, a halogen atom, or an aryloxy group in Formula I.

Preferred examples of the cyan couplers represented by Formula I according to the present invention will now be set forth below, but the present invention should not be construed as being limited thereto.

C-1

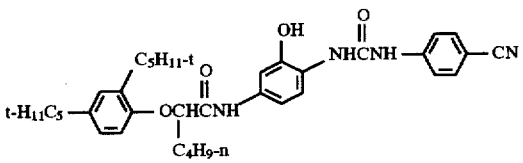

C-2

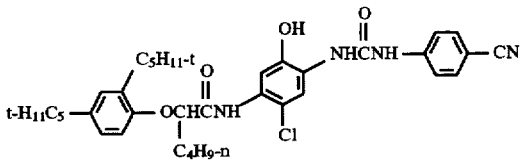

C-3

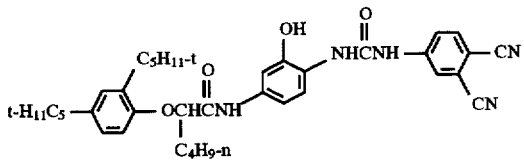

C-4

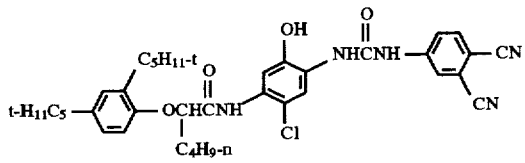

C-5

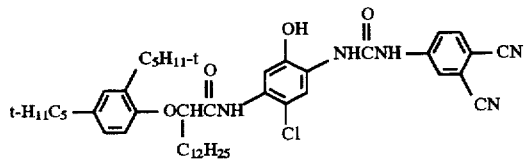

C-6

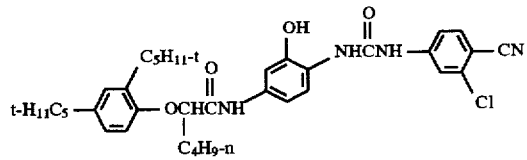

C-7

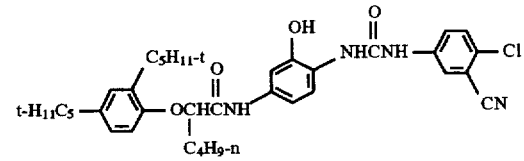

C-8

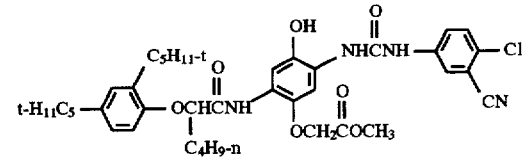

-continued

C-9

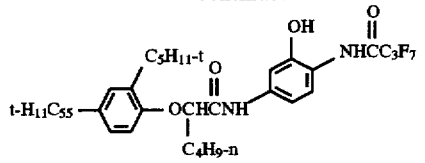

C-10

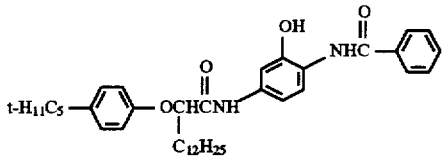

C-11

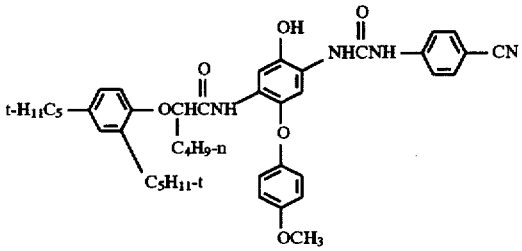

C-12

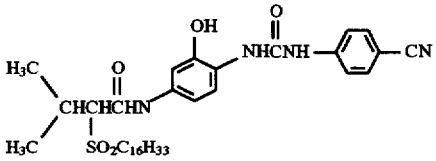

C-13

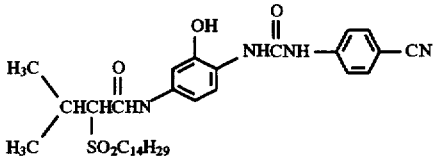

C-14

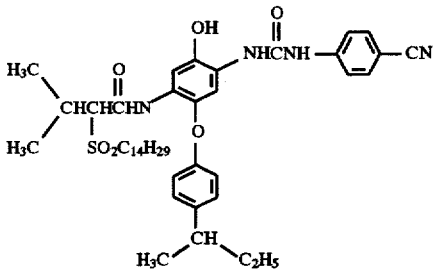

C-15

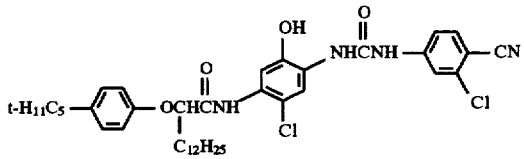

C-16

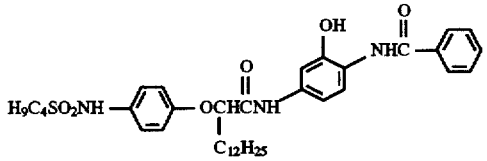

The dispersion of the cyan couplers of Formula I for use in the invention can be prepared by dissolving the couplers in a low-boiling or partially water-soluble auxiliary organic solvent with or without a high-boiling permanent organic solvent (including those solvents of formulas II-V provided that the ratio of these solvents to coupler in the dispersion is 0.50 or less). The resulting organic solution may then be mixed with an aqueous gelatin solution, and the mixture is then passed through a mechanical mixing device suitable for high-shear or turbulent mixing generally suitable for preparing photographic emulsified dispersions, such as a colloid mill, homogenizer, microfluidizer, high speed mixer, ultrasonic dispersing apparatus, blade mixer, device in which a liquid stream is pumped at high pressure through an orifice or interaction chamber, Gaulin mill, blender, etc., to form small particles of the organic phase suspended in the aqueous phase. More than one type of device may be used to prepare the dispersions. The auxiliary organic solvent is then removed by evaporation, noodle washing, or membrane dialysis. The dispersion particles preferably have an average particle size of less than 2 microns, generally from about 0.02 to 2 microns, more preferably from about 0.02 to 0.5 micron. These methods are described in detail in U.S. Pat. Nos. 2,322,027, 2,787,544, 2,801,170, 2,801,171, 2,949,360, and 3,396,027, the disclosures of which are incorporated by reference herein.

Examples of suitable auxiliary solvents which can be used in the present invention include: ethyl acetate, isopropyl acetate, butyl acetate, ethyl propionate, 2-ethoxyethylacetate, 2-(2-butoxyethoxy) ethyl acetate, dimethylformamide, 2-methyl tetrahydrofuran, triethylphosphate, cyclohexanone, butoxyethyl acetate, methyl isobutyl ketone, methyl acetate, 4-methyl-2-pentanol, diethyl carbitol, 1,1,2-trichloroethane, 1,2-dichloropropane, and the like. Preferred auxiliary solvents included ethyl acetate and 2-(2-butoxyethyoxy) ethyl acetate.

In preferred embodiments of the invention, the coupler of Formula I is dispersed without any high-boiling organic solvent to form a coupler dispersion substantially free of permanent organic solvent in accordance with copending, commonly assigned U.S. patent application Ser. No. 08/409,368 referenced above, the disclosure of which is hereby incorporated by reference. For the purposes of this invention, "substantially free of permanent organic solvent", "no-solvent", and like terms are intended to denote the absence of permanent solvents beyond trace or impurity levels. Such no solvent dispersions have been found to unexpectedly provide improved performance with respect to crystallization problems in comparison to dispersions having low solvent levels.

The aqueous phase of the coupler dispersions of the invention preferably comprise gelatin as a hydrophilic colloid. This may be gelatin or a modified gelatin such as acetylated gelatin, phthalated gelatin, oxidized gelatin, etc. Gelatin may be base-processed, such as lime-processed gelatin, or may be acid-processed, such as acid processed ossein gelatin. Other hydrophilic colloids may also be used, such as a water-soluble polymer or copolymer including, but not limited to poly(vinyl alcohol), partially hydrolyzed poly(vinylacetate-co-vinyl alcohol), hydroxyethyl cellulose, poly(acrylic acid), poly(1-vinylpyrrolidone), poly(sodium styrene sulfonate), poly(2-acrylamido-2-methane sulfonic acid), polyacrylamide. Copolymers of these polymers with hydrophobic monomers may also be used.

A surfactant may be present in either the aqueous phase or the organic phase or the dispersions can be prepared without any surfactant present. Surfactants may be cationic, anionic, zwitterionic or non-ionic. Ratios of surfactant to liquid organic solution typically are in the range of 0.5 to 25 wt. % for forming small particle photographic dispersions. In a preferred embodiment of the invention, an anionic surfactant is contained in the aqueous gelatin solution. Particularly preferred surfactants which are employed in the present invention include an alkali metal salt of an alkarylene sulfonic acid, such as the sodium salt of dodecyl benzene sulfonic acid or sodium salts of isopropylnaphthalene sulfonic acids, such as mixtures of di-isopropyl- and tri-isopropylnaphthalene sodium sulfonates; an alkali metal salt of an alkyl sulfuric acid, such as sodium dodecyl sulfate; or an alkali metal salt of an alkyl sulfosuccinate, such as sodium bis (2-ethylhexyl) succinic sulfonate.

The dispersions of couplers used in the method of the invention may contain more than one cyan coupler of Formula I, although it is not necessary that more than one coupler be employed to obtain the advantages of the invention. Preferred embodiments of the invention use dispersions of a single cyan coupler of Formula I substantially free of other cyan dye forming couplers. By "substantially free" is meant the absence of other cyan dye forming couplers beyond trace or impurity levels.

The high-boiling organic solvents represented by formulas II–V are described below.

In Formula II, $R_4$ and $R_5$ may be the same or different, each is an alkoxycarbonyl group containing not more than 8 carbon atoms, such as methoxycarbonyl, ethoxycarbonyl, propoxycarbonyl, butoxycarbonyl, benzyloxycarbonyl, etc.; and m is an integer from 1 to 10, preferably from 4 to 8.

Representative examples of the high-boiling organic solvents according to formula II are shown below:

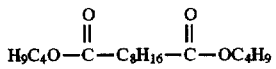
II-1

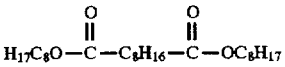
II-2

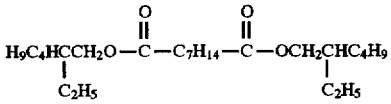
II-3

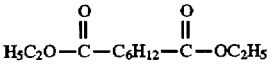
II-4

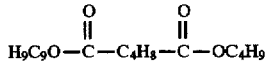
II-5

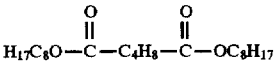
II-6

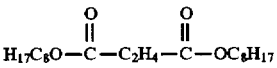
II-7

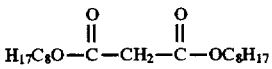
II-8

In formula III, the alkyl or alkenyl group represented by $R_6$ may be substituted or unsubstituted, and $R_7$ and $R_8$ are individually selected from hydrogen and the group of moieties from which $R_6$ is selected, provided that the total number of carbon atoms contained in $R_6$, $R_7$, and $R_8$ is at least 10.In a preferred embodiment, at least one of $R_7$ and $R_8$ is hydrogen, and more preferably both of $R_7$ and $R_8$ are hydrogen.

Representative examples of compounds represented by Formula III are given below:

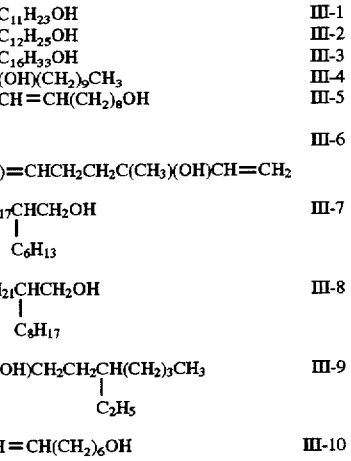
III-1
III-2
III-3
III-4
III-5
III-6
III-7
III-8
III-9
III-10

In formula IV, the groups represented by $R_9$ and $R_{10}$ are hydrogen or straight chain or branched alkyl groups, with the requirements that at least one of $R_9$ or $R_{10}$ is not hydrogen, the total number of carbon atoms in $R_9$ plus $R_{10}$ is from 9 to 20, and $R_{10}$ is in the para or a meta position with respect to the phenolic hydroxyl group.

Representative examples of the compounds represented by Formula IV are given below:

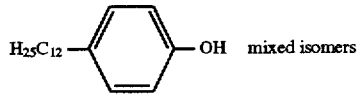
IV-1

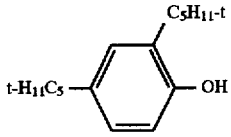
IV-2

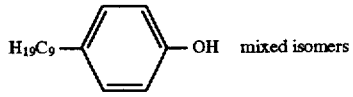
IV-3

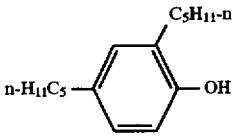
IV-4

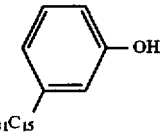
IV-5

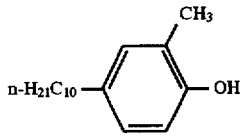
IV-6

In formula V, the group $R_{11}$ represents an aliphatic group, an aromatic group, or a heterocyclic group, and $R_{12}$ represents a hydrogen atom, a hydroxy group, an alkoxy group, or an aliphatic group. Such $R_{11}$ and $R_{12}$ groups may be further substituted or unsubstituted Representative examples of the compounds represented by Formula V are given below:

V-1

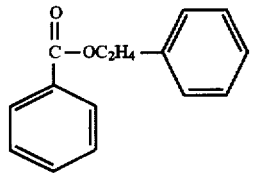

V-2

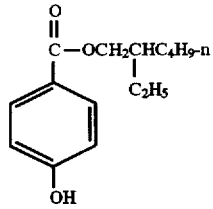

V-3

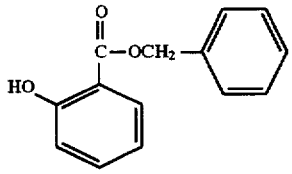

In a preferred embodiment, the cyan coupler of Formula I is dispersed as previously described without any high-boiling organic solvent, and then later combined with a separate dispersion of high-boiling solvent of formulas II–V in an aqueous coating solution.

Aqueous dispersions of high-boiling solvents of formulas II–V can be prepared similarly to the coupler dispersion, e.g., by adding the solvent to an aqueous medium and subjecting such mixture to high shear or turbulent mixing as described above. The aqueous medium is preferably a gelatin solution, and surfactants and auxiliary solvents may also be used as described above. In a preferred embodiment, a hydrophobic additive is dissolved in the solvent to prevent particle growth as described in copending, commonly assigned U.S. patent application Ser. No. 07/978,104, filed Nov. 18, 1992, the disclosure of which is incorporated by reference. The mixture is then passed through a mechanical mixing device such as a colloid mill, homogenizer, microfluidizer, high speed mixer, ultrasonic dispersing apparatus, etc. to form small particles of the organic solvent suspended in the aqueous phase. If an auxiliary solvent is employed, it is then subsequently removed by evaporation, noodle washing, or membrane dialysis. These methods are described in detail in the aforementioned references on dispersion making. The solvent dispersion may be a "blank" dispersion which does not contain any additional photographically useful compounds, or the solvent may be part of a photographically useful compound dispersion.

An aqueous coating solution in accordance with the present invention may then be prepared by combining a cyan coupler dispersion with the separate dispersion of the high-boiling organic solvent of formulas II–V. Other ingredients may also be contained in this solution such as silver halide emulsions, dispersions or solutions of other photographically useful compounds, additional gelatin, or acids and bases to adjust the pH. These ingredients may then be mixed with a mechanical device at an elevated temperature (e.g., 30° to 50° C.) for a short period of time (e.g., 5 min to 4 hours) prior to coating.

In accordance with the invention, the coupler and solvent dispersions are combined in a coating solution such that the weight ratio of high boiling organic solvent of formulas II–V to coupler of formula I in such solution is from 0.1 to 0.5, more preferably from 0.1 to 0.35, and most preferably from 0.2 to 0.3. It is an unexpected advantage of the invention that the particular high boiling solvents provide relatively higher coupler reactivity for couplers of formula I at low levels of coupler solvent in comparison to other conventional high boiling solvents. When used at lower ratios than specified above, coupler reactivity is generally not increased to as high a level as is desired. When used at higher ratios, the advantages associated with reduced coupler solvent levels are undesirably compromised.

With the present invention, it is possible to produce a silver halide light-sensitive photographic material which employs specific phenolic cyan couplers with a minimal level of high-boiling organic solvent to reduce coated dry thickness while maintaining high coupler reactivity to obtain adequate dye density upon processing the photographic material and avoiding coupler crystallization problems exhibited by low solvent dispersions of these couplers.

Photographic elements comprising coupler dispersions in accordance with the invention can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, antihalation layers, overcoat layers, subbing layers, and the like.

If desired, the photographic element can be used in conjunction with an applied magnetic layer as described in *Research Disclosure*, November 1992, Item 34390.It is also specifically contemplated to use dispersions according to the invention in combination with technology useful in small format film as described in *Research Disclosure*, June 1994, item 36230. *Research Disclosure* is published by Kenneth Mason Publications, Ltd., Dudley House, 12 North Street, Emsworth, Hampshire P010 7DQ, ENGLAND.

In the following discussion of suitable materials for use in the emulsions and elements that can be used in conjunction with this photographic element, reference will be made to *Research Disclosure*, September 1994, Item 36544, available as described above, which will be identified hereafter by the term "*Research Disclosure*." The contents of the *Research Disclosure*, including the patents and publications referenced therein, are incorporated herein by reference, and the Sections hereafter referred to are Sections of the *Research Disclosure*, Item 36544.

The silver halide emulsions employed in these photographic elements can be either negative-working or positive-working. Suitable emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing can be found in Sections XI–XX.

In addition to the cyan couplers of Formula I included in the dispersions of the invention, other photographic couplers may also be included in elements of the invention. Couplers that form cyan dyes upon reaction with oxidized color developing agents are described in such representative patents and publications as: U.S. Pat. Nos. 2,367,531; 2,423,730; 2,474,293; 2,772,162; 2,895,826; 3,002,836; 3,034,892; 3,041,236; 4,333,999; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 544,322; 556,700; 556,777; 565,096; 570,006; and 574,948.Especially preferred embodiments of the invention include the use of a cyan coupler of Formula I as the principle cyan dye forming image coupler.

Couplers that form magenta dyes upon reaction with oxidized color developing agent which can be incorporated in elements of the invention are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Preferred couplers include 1H-pyrazolo [5,1-c]-1,2,4-triazoles and 1H-pyrazolo [1,5-b]-1,2,4-triazoles. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent applications 176,804; 177,765; U.S. Pat. Nos. 4,659,652; 5,066,575; and 5,250,400. Especially preferred are pyrazolone couplers, such as described in U.S. Pat. No. 4,853,319.

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928; 4,022,620; 4,443,536 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

To control the migration of various components coated in a photographic layer, including couplers, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. Alternatively, the molecule can be made immobile by attachment to polymeric backbone.

It may be useful to use a combination of couplers any of which may contain known ballasts or coupling-off groups such as those described in U.S. Pat. Nos. 4,301,235; 4,853,319 and 4,351,897.

It is also contemplated that the materials and processes described in an article titled "Typical and Preferred Color Paper, Color Negative, and Color Reversal Photographic Elements and Processing," published in *Research Disclosure*, February 1995, Volume 370 may also be advantageously used with the dispersions of the invention.

The invention materials may further be used in combination with a photographic element containing image-modifying compounds such as "Developer inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.Such compounds are also disclosed in "Developer—Inhibitor—Releasing (DIR) Couplers for Color Photography," C. R. Barr, J. R. Thirtle and P. W. Vittum in *Photographic Science* and *Engineering*, Vol. 13, p. 174 (1969), incorporated herein by reference.

Especially useful for use with this invention are tabular grain silver halide emulsions. Suitable tabular grain emulsions can be selected from among a variety of conventional teachings, such as those of the following: Research Disclosure, Item 22534, January 1983; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069; 5,061,616; and 5,320,938.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Specifically contemplated and preferred are Se and Ir doped tabular emulsions as described in U.S. Pat. No. 5,164,292.Usage of the invention in combination with thin layers as described in U.S. Pat. No. 5,322,766 is also specifically contemplated and preferred.

The emulsions can be spectrally sensitized with any of the dyes known to the photographic art, such as the polymethine dye class, which includes the cyanines, merocyanines, complex cyanines and merocyanines, oxonols, hemioxonols, styryls, merostyryls and streptocyanines. In particular, it would be advantageous to use the low staining sensitizing dyes disclosed in U.S. Pat. Nos. 5,316,904, 5,292,634, 5,354,651, and EP Patent Application 93/203193.3, in conjunction with elements of the invention.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

The following examples are given to illustrate the invention in greater detail. Unless otherwise specified, all percentages and ratios are based on weight.

EXAMPLE 1

A no-solvent coupler dispersion was prepared as follows. 3300 g of cyan coupler C-1 was dissolved in 6600 g of ethyl acetate at 71° C. This oil phase solution was then combined with an aqueous phase solution consisting of 4400 g gelatin, 3520 g of a 10% solution of Alkanol-XC (Dupont) surfactant and 37,180 g of distilled water. This mixture was then passed through a Crepaco homogenizer one time at a pressure of 1500 psi followed by removal of ethyl acetate by evaporation. Distilled water was then added back to form Dispersion A which consisted of 6% coupler, 8% gel.

A high boiling solvent dispersion was prepared as follows. 4 g of Irganox-1076 (Ciba-Geigy) hydrophobic additive was dissolved in 400 g of dibutylphthalate at 50° C., then combined with an aqueous solution consisting of 400 g gelatin, 300 g of a 10% solution of Alkanol-XC (Dupont), 7.2 g of a 0.7% solution of Kathon LX (Rohm and Haas) biocide, and 3488.8 g of distilled water, also at 50° C. This mixture was then pre-mixed using a Silverson mixer for 5 min at 5000 rpm, then passed through a Crepaco homogenizer one time at 5000 psi to form Dispersion B which consisted of 8% solvent, 8% gel.

Dispersions of other high-boiling solvents were prepared like Dispersion B except that 400 g of dibutylphthalate was replaced with 400 g of another high boiling solvent as outlined in Table I below.

Table I

| Dispersion | High-Boiling Solvent |
|---|---|
| B | dibutylphthalate |
| C | tricresylphosphate |
| D | dibutylsebacate (formula II-1) |
| E | oleyl alcohol (formula III-5) |
| F | phenylethylbenzoate (formula V-1) |

A coating solution was prepared as follows. 36.7 g of Dispersion A was added to 13.8 g of Dispersion B with 12.6 g of 35% gelatin and 40.2 g of distilled water. The mixture was heated to 40° C. for 1 hour with stirring to form coating solution BB which consisted of 2.2% coupler, 1.1% solvent, and 8.4% gel.

Coating solutions containing dispersions of other high-boiling solvents were also similarly prepared as outlined in Table II below. Coating solution AA, which contained no added solvent, was also included as a control.

Coupling rate constants (k) for the reaction of coupler with oxidized color developing agent CD-4 were measured for these coating solutions using an aqueous competition test with sulfite ion as described in Cols. 22–23 of U.S. Pat. No. 5,089,380.Results are reported in units of $m^{-1}$ $sec^{-1}$ and are included in Table II.

TABLE II

| Coating Solution | Dispersions | Coupler Solvent | Coupler Reactivity (k) |
|---|---|---|---|
| AA | A | — | 540 |
| BB | A, B | dibutylphthalate | 3620 |
| CC | A, C | tricresylphosphate | 1104 |
| DD (Invention) | A, D | Formula II-1 dibutylsebacate | 5000 |
| EE (Invention) | A, E | Formula III-5 oleyl alcohol | 5519 |
| FF (Invention) | A, F | Formula V-1 phenylethylbenzoate | 5538 |

These results clearly demonstrate that the solvents of the present invention provide higher coupler reactivity than the solvents employed in the prior art when used at low levels according to the method of the present invention.

EXAMPLE 2

Photographic Sample 201 (comparative control)

A color photographic recording material for color negative development was prepared by applying the following layers in the given sequence to a transparent support of cellulose triacetate. The side of the support to be coated had been prepared by gelatin subbing. The quantities of silver halide are given in g of silver/$m^2$. The quantities of other materials are given in g/$m^2$. The cyan dye-forming coupler C-1 employed in the red-sensitive layer was dispersed with a ratio of high boiling solvent S-1, di-n-butylphthalate, to coupler of 1.0.

| Layer 1: Antihalation Layer | |
|---|---|
| UV-1 | 0.038 |
| UV-2 | 0.038 |
| Oxidized developer scavenger DOXS-1 | 0.108 |
| Compensatory printing density cyan dye CD-1 | 0.016 |
| Compensatory printing density magenta dye MD-1 | 0.043 |
| Compensatory printing density yellow dye MM-1 | 0.097 |
| S-1 | 0.237 |
| S-4 | 0.172 |
| S-9 | 0.060 |
| Disodium salt of 3,5-disulfocatechol | 0.270 |
| Gelatin | 2.441 |
| Black colloidal silver sol | 0.151 |

Layer 2: Red-Sensitive Layer

This layer comprised a blend of a lower sensitivity, red-sensitized tabular silver iodobromide emulsion (1.3% iodide, average grain diameter 0.53 micrometers and thickness 0.09 micrometers thick) and a higher sensitivity, red-sensitized tabular silver iodobromide emulsion (4.1% iodide, average grain diameter 1.04 micrometers and thickness 0.09 micrometers).

| | |
|---|---|
| Lower sensitivity emulsion | 0.409 |
| Higher sensitivity emulsion | 0.441 |
| Bleach accelerator coupler BAR-1 | 0.038 |
| Cyan dye-forming coupler C-1 | 0.538 |
| Cyan dye-forming magenta colored coupler CM-1 | 0.027 |
| Oxidized developer scavenger DOXS-3 | 0.010 |
| S-1 | 0.538 |
| S-2 | 0.038 |
| TAI | 0.015 |
| Gelatin | 1.722 |
| Layer 3: Ultraviolet Filter Layer | |
| Dye UV-1 | 0.108 |
| Dye UV-2 | 0.108 |
| Unsensitized silver bromide Lippmann emulsion | 0.215 |
| S-9 | 0.172 |
| Gelatin | 0.699 |
| Layer 4: Protective Overcoat Layer | |
| Polymethylmethacrylate matte beads | 0.005 |
| Soluble polymethylmethacrylate matte beads | 0.054 |
| Silicone lubricant | 0.039 |
| Gelatin | 0.888 |

This film was hardened at coating with 1.75% by weight of total gelatin of hardener H-1. Surfactants, coating aids, soluble absorber dyes and stabilizers were added to the various layers of this sample as is commonly practiced in the art.

Photographic Sample 202 (comparative control)

A color photographic recording material for color negative development was prepared exactly as Sample 201 above, except where noted below. The cyan dye-forming coupler C-1 employed in the red-sensitive layer of Sample 201 was dispersed in the general manner of example A in dispersion Example 1, without the presence of a high boiling solvent.

| Layer 2: Red-Sensitive Layer Changes | |
|---|---|
| S-1 | 0.000 |

Photographic Sample 203 (comparative control)

A color photographic recording material for color negative development was prepared exactly as Sample 202, except where noted below. A separate dispersion of S-1 dispersed in the general manner of dispersion B of Example 1 was added to the liquid coating solution of the red-sensitive layer, Layer 2, comprising coupler C-1 dispersed in the general manner of dispersion A in Example 1 to provide a 25% coverage by weight to that of cyan dye-forming coupler C-1.

| Layer 2: Red-Sensitive Layer Changes | |
|---|---|
| S-1 | 0.135 |

Photographic Sample 204 (comparative control)

A color photographic recording material for color negative development was prepared exactly as Sample 202, except where noted below. A separate dispersion of S-1 dispersed in the general manner of dispersion B of Example 1 was added to the liquid coating solution of layer 2 comprising coupler C-1 dispersed in the general manner of dispersion A in Example 1 to provide 50% coverage by weight to that of cyan dye-forming coupler C-1.

| Layer 2: Red-Sensitive Layer Changes | |
|---|---|
| S-1 | 0.269 |

Photographic Sample 205 (comparative control)

A color photographic recording material for color negative development was prepared exactly as Sample 202, except where noted below. A separate dispersion of S-1 dispersed in the general manner of dispersion B of Example 1 was added to the liquid coating solution of layer 2 comprising coupler C-1 dispersed in the general manner of dispersion A in Example 1 to provide equal coverage by weight to that of cyan dye-forming coupler C-1.

| Layer 2: Red-Sensitive Layer Changes | |
|---|---|
| S-1 | 0.538 |

Photographic Sample 206 (invention)

A color photographic recording material for color negative development was prepared exactly as Sample 202, except where noted below. A separate dispersion of high boiling solvent S-8 (dibutylsebacate of formula II-1) dispersed in the general manner of dispersion D of Example 1 was added to the liquid coating solution of layer 2 comprising coupler C-1 dispersed in the general manner of dispersion A in Example 1 to provide 25% coverage by weight to that of cyan dye-forming coupler C-1.

| Layer 2: Red-Sensitive Layer Changes | |
|---|---|
| S-8 | 0.129 |
| S-1 | 0.0 |

Photographic Sample 207 (invention)

A color photographic recording material for color negative development was prepared exactly as Sample 202, except where noted below. A separate dispersion of S-8 dispersed in the general manner of dispersion D of Example 1 was added to the liquid coating solution of layer 2 comprising coupler C-1 dispersed in the general manner of dispersion A in Example 1 to provide 50% coverage by weight to that of cyan dye-forming coupler C-1.

| Layer 2: Red-Sensitive Layer Changes | |
|---|---|
| S-8 | 0.269 |
| S-1 | 0.0 |

Photographic Sample 208 (comparative control)

A color photographic recording material for color negative development was prepared exactly as Sample 202, except where noted below. A separate dispersion of S-8 dispersed in the general manner of dispersion D of Example 1 was added to the liquid coating solution of layer 2 comprising coupler C-1 dispersed in the general manner of dispersion A in Example 1 to provide equal coverage by weight to that of cyan dye-forming coupler C-1.

| Layer 2: Red-Sensitive Layer Changes | |
|---|---|
| S-8 | 0.538 |
| S-1 | 0.0 |

Samples of photographic recording materials Sample 201–208 were individually exposed for 1/50 of a second to white light from a tungsten light source of 3200° K color temperature that was filtered by a Daylight Va filter to 5500° K and a KODAK WRATTEN GELATIN Filter (#9) through a graduated 0–4.0 density step tablet to determine their speed and gamma. The samples were then processed using a color negative process, the Kodak C-41 process, as described by the 1988 Annual of the British journal of Photography, pages 196–198.Another description of the use of the C-41 Flexicolor Process can be found in "Using KODAK FLEXICOLOR Chemicals", Publication Z-131, Eastman Kodak Company, Rochester, N.Y. (KODAK is a trademark of the Eastman Kodak Company, U.S.A.).

Following processing and drying, Samples 201–208 were subjected to Status M densitometry. The photographic performance of the recording materials is compared below in Table III.

TABLE III

Red-Light Sensitive Unit Performance

| Sample | Layer 2 Dispersions | Solvent/C-1 Ratio in Layer 2 | MODEL G Gradient Meter Gamma (Ratio of S-8/S-1) | Den. at −0.9 logH | Den. at 0.3 logH |
|---|---|---|---|---|---|
| 201 (control) | C-1 in S-1 | 1.0 | 1.45 | 1.29 | 2.01 |
| 202 (control) | C-1 as A | 0 | 1.02 | 1.02 | 1.67 |
| 203 (control) | C-1 as A + S-1 as B | 0.25 | 1.22 | 1.17 | 1.94 |
| 204 (control) | C-1 as A + S-1 as B | 0.50 | 1.35 | 1.27 | 1.97 |
| 205 (control) | C-1 as A + S-1 as B | 1.0 | 1.48 | 1.34 | 1.98 |
| 206 (invention) | C-1 as A + S-8 as D | 0.25 | 1.34 (1.10) | 1.24 | 1.98 |
| 207 (invention) | C-1 as A + S-8 as D | 0.50 | 1.40 (1.04) | 1.31 | 2.02 |
| 208 (control) | C-1 as A + S-8 as D | 1.0 | 1.47 (0.99) | 1.35 | 2.05 |

The photographic data for Sample 202 show that the high boiling solvent-free dispersion of cyan dye-forming coupler C-1 provides much lower gamma and upperscale density formation performance following direct substitution for the comparative control dispersion employing S-1, di-n-butylphthalate, in a weight ratio 1.0 to C-1 in the red-sensitive layer of the color negative recording material of Example 201. The photographic data for Sample 203 and 204 show that the comparative high boiling solvent of the art, S-1, when combined with the solvent-free dispersion of cyan dye-forming coupler C-1 in a weight ratio of 0.25–0.50 during the preparation of the liquid coating solutions, still gives reduced density formation response. Comparative control Sample 205 gives essentially the same result as Sample 201, indicating that method of combining the solvent-free dispersion of coupler C-1 with the dispersion of high boiling solvent S-1 in the liquid coating solution of the red-sensitive layer yields about the same performance as making a conventional dispersion of C-1 and S-1 at the normal ratio of 1.0.

Under identical conditions of usage at the lower solvent-to-coupler ratios in Samples 206 and 207, the inventive combination of solvent S-8 dispersed in the manner of dispersion D of Example 1 and coupler C-1 dispersed solvent-free in the manner of dispersion A give increased gamma response and density formation relative to the respective controls, 203 and 204. Under the usual conditions of solvent-to-coupler ratio of 1.0 however, the combination of S-8 and C-1 is observed to function equivalently to that with S-1. The benefit of the invention is thus seen to appear at a solvent-to-coupler ratio by weight of about 0.5, and the improvement increases as the ratio decreases, as noted in Table III by the ratio of relative gamma performance for the S-8 films compared to the corresponding S-1 films. The gamma ratio is about unity at the usual solvent-to-coupler ratio of 1.0, and a performance advantage of fully 10% is gained by using S-8 at the solvent-to-coupler ratio of 0.25, matching the performance of a twofold higher level of S-1. In this fashion, the improved crystallization stability of the solvent-free dispersion of C-1 is enjoyed, while the reduced solvent load afforded by the use of the inventive high boiling solvents with C-1 allows for reduced materials coverage, thinner layers, and equivalent photographic performance.

EXAMPLE 3

Photographic Sample 301 (comparative control)

A color photographic recording material for color negative development was prepared by applying the following layers in the given sequence to a transparent support of cellulose triacetate. The side of the support to be coated had been prepared by gelatin subbing. The quantities of silver halide are given in g of silver/m$^2$. The quantities of other materials are given in g/m$^2$. The cyan dye-forming coupler C-1 employed in the low, medium, and high sensitivity red-sensitive layers was dispersed with a ratio of high boiling solvent S-1, di-n-butylphthalate, to coupler of 1.0.

| Layer 1: Antihalation Layer | |
|---|---|
| UV-1 | 0.075 |
| UV-2 | 0.075 |
| Oxidized developer scavenger DOXS-2 | 0.162 |
| Compensatory printing density cyan dye CD-2 | 0.020 |
| Compensatory printing density magenta dye MD-1 | 0.042 |
| Compensatory printing density yellow dye MM-1 | 0.088 |
| Compensatory printing density yellow dye YD-1 | 0.008 |
| S-4 | 0.426 |
| S-9 | 0.151 |
| Disodium salt of 3,5-disulfocatechol | 0.270 |

-continued

| Layer 1: Antihalation Layer | |
|---|---|
| Gelatin | 2.441 |
| Black colloidal silver sol | 0.151 |

Layer 2: Low Sensitivity Red-Sensitive Layer

This layer comprised a blend of a lower sensitivity, red-sensitized tabular silver iodobromide emulsion (1.3% iodide, average grain diameter 0.53 micrometers and thickness 0.09 micrometers thick) and a higher sensitivity, red-sensitized tabular silver iodobromide emulsion (4.1% iodide, average grain diameter 1.04 micrometers and thickness 0.09 micrometers).

| | |
|---|---|
| Lower sensitivity emulsion | 0.495 |
| Higher sensitivity emulsion | 0.431 |
| Bleach accelerator coupler BAR-1 | 0.038 |
| Cyan dye-forming coupler C-1 | 0.517 |
| Cyan dye-forming magenta colored coupler CM-1 | 0.027 |
| Oxidized developer scavenger DOXS-3 | 0.010 |
| S-1 | 0.517 |
| S-2 | 0.038 |
| TAI | 0.015 |
| Gelatin | 1.775 |

Layer 3: Medium Sensitivity Red-Sensitive Layer

Red-sensitized tabular silver iodobromide emulsion (4.1 mol % iodide, average grain diameter 1.39 micrometers and thickness 0.12 micrometers).

| | |
|---|---|
| Emulsion | 0.700 |
| DIR coupler D-1 | 0.011 |
| Cyan dye-forming magenta colored coupler CM-1 | 0.022 |
| Cyan dye-forming coupler C-1 | 0.215 |
| S-1 | 0.215 |
| S-3 | 0.022 |
| TAI | 0.011 |
| Gelatin | 1.786 |

Layer 4: High Sensitivity Red-Sensitive Layer

Red-sensitized, tabular silver iodobromide emulsion (4.1 mol % iodide, average grain diameter 2.93 micrometers and thickness 0.13 micrometers).

| | |
|---|---|
| Emulsion | 1.076 |
| DIR coupler D-1 | 0.020 |
| DIR coupler D-2 | 0.048 |
| Cyan dye-forming magenta colored coupler CM-1 | 0.032 |
| Cyan dye-forming coupler C-1 | 0.139 |
| S-4 | 0.194 |
| S-1 | 0.139 |
| S-3 | 0.041 |
| TAI | 0.010 |
| Gelatin | 1.711 |
| Layer 5: Interlayer | |
| Gelatin | 1.292 |

Layer 6: Low Sensitivity Green-Sensitive Layer

This layer comprised a blend of lower sensitivity, green-sensitized tabular silver iodobromide emulsion (1.3 mol % iodide, average grain diameter 0.53 micrometers and thickness 0.09 micrometers) and higher sensitivity, green-sensitized tabular silver iodobromide emulsion (4.1 mol % iodide, average grain diameter 1.04 micrometers and thickness 0.09 micrometers).

| | |
|---|---|
| Lower sensitivity emulsion | 0.581 |
| Higher sensitivity emulsion | 0.312 |
| Magenta dye-forming yellow colored coupler MM-2 | 0.065 |
| Magenta dye-forming coupler M-1 | 0.269 |
| Oxidized developer scavenger DOXS-3 | 0.023 |
| S-4 | 0.345 |
| TAI | 0.014 |
| Gelatin | 1.723 |

Layer 7: Medium Sensitivity Green-Sensitive Layer

Green-sensitized tabular silver iodobromide emulsion (4.1 mol % iodide, average grain diameter 1.23 micrometers and thickness 0.12 micrometers).

| | |
|---|---|
| Emulsion | 0.969 |
| DIR coupler D-1 | 0.024 |
| Magenta dye-forming yellow colored coupler MM-2 | 0.065 |
| Magenta dye-forming coupler M-1 | 0.070 |
| Oxidized developer scavenger DOXS-3 | 0.019 |
| S-4 | 0.186 |
| S-3 | 0.048 |
| TAI | 0.014 |
| Gelatin | 1.399 |

Layer 8: High Sensitivity Green-Sensitive Layer Green-sensitized, tabular silver iodobromide emulsion (4.1 mol % iodide, average grain diameter 2.19 micrometers and thickness 0.13 micrometers)

| | |
|---|---|
| Emulsion | 0.969 |
| DIR coupler D-3 | 0.011 |
| DIR coupler D-4 | 0.011 |
| Magenta dye-forming yellow colored coupler MM-2 | 0.054 |
| Magenta dye-forming coupler M-1 | 0.058 |
| Oxidized developer scavenger DOXS-3 | 0.016 |
| S-4 | 0.176 |
| S-1 | 0.011 |
| TAI | 0.012 |
| Gelatin | 1.291 |
| Layer 9: Yellow Filter Layer | |
| Yellow filter dye YD-2 | 0.108 |
| Gelatin | 1.292 |

Layer 10: Low Sensitivity Blue-Sensitive Layer

This layer comprised a blend of lower sensitivity, blue-sensitized tabular silver iodobromide emulsion (1.3 mol % iodide, average grain diameter 0.53 micrometers and thickness 0.09 micrometers), medium sensitivity, tabular blue-sensitized silver iodobromide emulsion (4.1 mol % iodide, average grain diameter 0.80 micrometers and thickness 0.09 micrometers) and higher sensitivity, tabular blue-sensitized silver iodobromide emulsion (6.0 mol % iodide, average grain diameter 0.96 micrometers and thickness 0.26 micrometers).

| | |
|---|---|
| Lower sensitivity emulsion | 0.269 |
| Medium sensitivity emulsion | 0.172 |
| Higher sensitivity emulsion | 0.549 |
| DIR coupler D-5 | 0.065 |
| Yellow dye-forming coupler Y-1 | 0.280 |
| Yellow dye-forming coupler Y-2 | 0.700 |
| Bleach accelerator coupler BAR-1 | 0.003 |
| Cyan dye-forming coupler C-1 | 0.027 |
| Oxidized developer scavenger DOXS-3 | 0.005 |
| S-1 | 0.931 |
| S-2 | 0.003 |

-continued

| | |
|---|---|
| TAI | 0.016 |
| Gelatin | 2.519 |

Layer 11: High Sensitivity Blue-Sensitive Layer

This layer comprised a blend of lower sensitivity, blue-sensitized silver iodobromide emulsion (9.0 mol % iodide, average grain diameter 1.06 micrometers) and higher sensitivity, tabular blue-sensitized silver iodobromide emulsion (4.1 mol % iodide, average grain diameter 3.37 micrometers and thickness 0.14 micrometers).

| | |
|---|---|
| Low sensitivity emulsion | 0.226 |
| High sensitivity emulsion | 0.570 |
| Yellow dye-forming coupler Y-1 | 0.080 |
| Yellow dye-forming coupler Y-2 | 0.200 |
| DIR coupler D-5 | 0.048 |
| Bleach accelerator coupler BAR-1 | 0.005 |
| Cyan dye-forming coupler C-1 | 0.029 |
| Oxidized developer scavenger DOXS-3 | 0.001 |
| S-1 | 0.317 |
| S-2 | 0.005 |
| TAI | 0.013 |
| Gelatin | 1.580 |
| Layer 12: Ultraviolet Filter Layer | |
| Dye UV-1 | 0.108 |
| Dye UV-2 | 0.108 |
| Unsensitized silver bromide Lippmann emulsion | 0.215 |
| S-9 | 0.215 |
| Gelatin | 0.699 |
| Layer 13: Protective Overcoat Layer | |
| Polymethylmethacrylate matte beads | 0.005 |
| Soluble polymethylmethacrylate matte beads | 0.054 |
| Silica gel particles | 0.108 |
| Silicone lubricant | 0.039 |
| Gelatin | 0.888 |

This film was hardened at coating with 1.75% by weight of total gelatin of hardener H-1. Surfactants, coating aids, soluble absorber dyes and stabilizers were added to the various layers of this sample as is commonly practiced in the art.

Photographic Sample 302 (comparative control)

A color photographic recording material for color negative development was prepared exactly as Sample 301 above, except where noted below. The cyan dye-forming coupler C-1 employed in the red-sensitive layers 2, 3, and 4 was dispersed in the general manner of example A in dispersion Example 1, without the presence of a high boiling solvent.

| | |
|---|---|
| Layer 2: Low Sensitivity Red-Sensitive Layer Changes | |
| S-1 | 0.000 |
| Layer 3: Medium Sensitivity Red-Sensitive Layer Changes | |
| S-1 | 0.000 |
| Layer 4: High Sensitivity Red-Sensitive Layer Changes | |
| S-1 | 0.000 |

Photographic Sample 303 (comparative control)

A color photographic recording material for color negative development was prepared exactly as Sample 302, except where noted below. A separate dispersion of S-4 dispersed in the general manner of dispersion C of Example 1 was added to the liquid coating solutions of layers 2, 3, and 4 comprising coupler C-1 dispersed in the general manner of dispersion A in Example 1 to provide an equal coverage by weight to that of cyan dye-forming coupler C-1.

| | |
|---|---|
| Layer 2: Low Sensitivity Red-Sensitive Layer Changes | |
| S-4 | 0.517 |
| S-1 | 0.0 |
| Layer 3: Medium Sensitivity Red-Sensitive Layer Changes | |
| S-4 | 0.215 |
| S-1 | 0.0 |
| Layer 4: High Sensitivity Red-Sensitive Layer Changes | |
| S-4 | 0.334 |
| S-1 | 0.0 |

Photographic Sample 304 (comparative control)

A color photographic recording material for color negative development was prepared exactly as Sample 302, except where noted below. A separate dispersion of S-1 dispersed in the general manner of dispersion B of Example 1 was added to the liquid coating solutions of layers 2, 3, and 4 comprising coupler C-1 dispersed in the general manner of dispersion A in Example 1 to provide 25% coverage by weight to that of cyan dye-forming coupler C-1.

| | |
|---|---|
| Layer 2: Low Sensitivity Red-Sensitive Layer Changes | |
| S-1 | 0.129 |
| Layer 3: Medium Sensitivity Red-Sensitive Layer Changes | |
| S-1 | 0.054 |
| Layer 4: High Sensitivity Red-Sensitive Layer Changes | |
| S-1 | 0.035 |

Photographic Sample 305 (comparative control)

A color photographic recording material for color negative development was prepared exactly as Sample 302, except where noted below. A separate dispersion of S-1 dispersed in the general manner of dispersion B of Example 1 was added to the liquid coating solutions of layers 2, 3, and 4 comprising coupler C-1 dispersed in the general manner of dispersion A in Example 1 to provide 50% coverage by weight to that of cyan dye-forming coupler C-1.

| | |
|---|---|
| Layer 2: Low Sensitivity Red-Sensitive Layer Changes | |
| S-1 | 0.258 |
| Layer 3: Medium Sensitivity Red-Sensitive Layer Changes | |
| S-1 | 0.108 |
| Layer 4: High Sensitivity Red-Sensitive Layer Changes | |
| S-1 | 0.070 |

Photographic Sample 306 (comparative control)

A color photographic recording material for color negative development was prepared exactly as Sample 302, except where noted below. A separate dispersion of S-1 dispersed in the general manner of dispersion B of Example 1 was added to the liquid coating solutions of layers 2, 3, and 4 comprising coupler C-1 dispersed in the general manner of dispersion A in Example 1 to provide equal coverage by weight to that of cyan dye-forming coupler C-1.

| Layer 2: Low Sensitivity Red-Sensitive Layer Changes | |
|---|---|
| S-1 | 0.517 |
| **Layer 3: Medium Sensitivity Red-Sensitive Layer Changes** | |
| S-1 | 0.215 |
| **Layer 4: High Sensitivity Red-Sensitive Layer Changes** | |
| S-1 | 0.139 |

Photographic Sample 307 (invention)

A color photographic recording material for color negative development was prepared exactly as Sample 302, except where noted below. A separate dispersion of high boiling solvent S-5 (formula III-5) dispersed in the general manner of dispersion E of Example 1 was added to the liquid coating solutions of layers 2, 3, and 4 comprising coupler C-1 dispersed in the general manner of dispersion A in Example 1 to provide 25% coverage by weight to that of cyan dye-forming coupler C-1.

| Layer 2: Low Sensitivity Red-Sensitive Layer Changes | |
|---|---|
| S-5 | 0.129 |
| S-1 | 0.0 |
| **Layer 3: Medium Sensitivity Red-Sensitive Layer Changes** | |
| S-5 | 0.054 |
| S-1 | 0.0 |
| **Layer 4: High Sensitivity Red-Sensitive Layer Changes** | |
| S-5 | 0.035 |
| S-1 | 0.0 |

Photographic Sample 308 (invention)

A color photographic recording material for color negative development was prepared exactly as Sample 302, except where noted below. A separate dispersion of S-5 dispersed in the general manner of dispersion E of Example 1 was added to the liquid coating solutions of layers 2, 3, and 4 comprising coupler C-1 dispersed in the general manner of dispersion A in Example 1 to provide 50% coverage by weight to that of cyan dye-forming coupler C-1.

| Layer 2: Low Sensitivity Red-Sensitive Layer Changes | |
|---|---|
| S-5 | 0.258 |
| S-1 | 0.0 |
| **Layer 3: Medium Sensitivity Red-Sensitive Layer Changes** | |
| S-5 | 0.108 |
| S-1 | 0.0 |
| **Layer 4: High Sensitivity Red-Sensitive Layer Changes** | |
| S-5 | 0.070 |
| S-1 | 0.0 |

Photographic Sample 309 (invention)

A color photographic recording material for color negative development was prepared exactly as Sample 302, except where noted below. A separate dispersion of high boiling solvent S-6 (formula V-1) dispersed in the general manner of dispersion F of Example 1 was added to the liquid coating solutions of layers 2, 3, and 4 comprising coupler C-1 dispersed in the general manner of dispersion A in Example 1 to provide 25% coverage by weight to that of cyan dye-forming coupler C-1.

| Layer 2: Low Sensitivity Red-Sensitive Layer Changes | |
|---|---|
| S-6 | 0.129 |
| S-1 | 0.0 |
| **Layer 3: Medium Sensitivity Red-Sensitive Layer Changes** | |
| S-6 | 0.054 |
| S-1 | 0.0 |
| **Layer 4: High Sensitivity Red-Sensitive Layer Changes** | |
| S-6 | 0.035 |
| S-1 | 0.0 |

Photographic Sample 310 (invention)

A color photographic recording material for color negative development was prepared exactly as Sample 302, except where noted below. A separate dispersion of S-6 dispersed in the general manner of dispersion F of Example 1 was added to the liquid coating solutions of layers 2, 3, and 4 comprising coupler C-1 dispersed in the general manner of dispersion A in Example 1 to provide 50% coverage by weight to that of cyan dye-forming coupler C-1.

| Layer 2: Low Sensitivity Red-Sensitive Layer Changes | |
|---|---|
| S-6 | 0.258 |
| S-1 | 0.0 |
| **Layer 3: Medium Sensitivity Red-Sensitive Layer Changes** | |
| S-6 | 0.108 |
| S-1 | 0.0 |
| **Layer 4: High Sensitivity Red-Sensitive Layer Changes** | |
| S-6 | 0.070 |
| S-1 | 0.0 |

Photographic Sample 311 (invention)

A color photographic recording material for color negative development was prepared exactly as Sample 302, except where noted below. A separate dispersion of high boiling solvent S-7 (formula IV-1) was added to the liquid coating solutions of layers 2, 3, and 4 comprising coupler C-1 dispersed in the general manner of dispersion A in Example 1 to provide 25% coverage by weight to that of cyan dye-forming coupler C-1.

| Layer 2: Low Sensitivity Red-Sensitive Layer Changes | |
|---|---|
| S-7 | 0.129 |
| S-1 | 0.0 |
| **Layer 3: Medium Sensitivity Red-Sensitive Layer Changes** | |
| S-7 | 0.054 |
| S-1 | 0.0 |
| **Layer 4: High Sensitivity Red-Sensitive Layer Changes** | |
| S-7 | 0.035 |
| S-1 | 0.0 |

Photographic Sample 312 (invention)

A color photographic recording material for color negative development was prepared exactly as Sample 302, except where noted below. A separate dispersion of S-7 was added to the liquid coating solutions of layers 2, 3, and 4 comprising coupler C-1 dispersed in the general manner of dispersion A in Example 1 to provide 50% coverage by weight to that of cyan dye-forming coupler C-1.

| Layer 2: Low Sensitivity Red-Sensitive Layer Changes | |
|---|---|
| S-7 | 0.258 |
| S-1 | 0.0 |
| **Layer 3: Medium Sensitivity Red-Sensitive Layer Changes** | |
| S-7 | 0.108 |
| S-1 | 0.0 |
| **Layer 4: High Sensitivity Red-Sensitive Layer Changes** | |
| S-7 | 0.070 |
| S-1 | 0.0 |

Photographic Sample 313 (invention)

A color photographic recording material for color negative development was prepared exactly as Sample 302, except where noted below. A separate dispersion of high boiling solvent S-8 (formula II-1) dispersed in the general manner of dispersion D of Example 1 was added to the liquid coating solutions of layers 2, 3, and 4 comprising coupler C-1 dispersed in the general manner of dispersion A in Example 1 to provide 25% coverage by weight to that of cyan dye-forming coupler C-1.

| Layer 2: Low Sensitivity Red-Sensitive Layer Changes | |
|---|---|
| S-8 | 0.129 |
| S-1 | 0.0 |
| **Layer 3: Medium Sensitivity Red-Sensitive Layer Changes** | |
| S-8 | 0.054 |
| S-1 | 0.0 |
| **Layer 4: High Sensitivity Red-Sensitive Layer Changes** | |
| S-8 | 0.035 |
| S-1 | 0.0 |

Photographic Sample 314 (invention)

A color photographic recording material for color negative development was prepared exactly as Sample 302, except where noted below. A separate dispersion of S-8 dispersed in the general manner of dispersion D of Example 1 was added to the liquid coating solutions of layers 2, 3, and 4 comprising coupler C-1 dispersed in the general manner of dispersion A in Example 1 to provide 50% coverage by weight to that of cyan dye-forming coupler C-1.

| Layer 2: Low Sensitivity Red-Sensitive Layer Changes | |
|---|---|
| S-8 | 0.258 |
| S-1 | 0.0 |
| **Layer 3: Medium Sensitivity Red-Sensitive Layer Changes** | |
| S-8 | 0.108 |
| S-1 | 0.0 |
| **Layer 4: High Sensitivity Red-Sensitive Layer Changes** | |
| S-8 | 0.070 |
| S-1 | 0.0 |

Samples of photographic recording materials Sample 301–314 were individually exposed for 1/500 of a second to white light from a tungsten light source of 3200° K color temperature that was filtered by a Daylight Va filter to 5500° K through a graduated 0–4.0 density step tablet to determine their speed and gamma. The samples were then processed using the color negative process, the KODAK C-41 process, as described by the 1988 Annual of the British Journal of Photography, pages 196–198.Following processing and drying, Samples 301–314 were subjected to Status M densitometry. The photographic performance of the recording materials is compared below in Table IV.

TABLE IV

Red-Light Sensitive Unit Performance

| Sample | Layer 2, 3, & 4 Dispersions | Solvent/C-1 Ratio In Layers 2–4 | Low-mid Scale Gamma | Density at .5 log H |
|---|---|---|---|---|
| 301 (control) | C-1 dispersed in S-1 | 1.0 | 0.62 | 2.30 |
| 302 (control) | C-1 dispersed as A | 0 | 0.35 | 1.49 |
| 303 (control) | C-1 as A + S-4 as C | 1.0 | 0.47 | 1.82 |
| 304 (control) | C-1 as A + S-1 as B | 0.25 | 0.44 | 1.69 |
| 305 (control) | C-1 as A + S-1 as B | 0.50 | 0.50 | 1.89 |
| 306 (control) | C-1 as A + S-1 as B | 1.0 | 0.60 | 2.19 |
| 307 (invention) | C-1 as A + S-5 as E | 0.25 | 0.56 | 2.04 |
| 308 (invention) | C-1 as A + s-s as E | 0.50 | 0.68 | 2.41 |
| 309 (invention) | C-1 as A + S-6 as F | 0.25 | 0.45 | 1.72 |
| 310 (invention) | C-1 as A + S-6 as F | 0.50 | 0.53 | 1.97 |
| 311 (invention) | C-1 as A + S-7 | 0.25 | 0.50 | 1.84 |
| 312 (invention) | C-1 as A + S-7 | 0.50 | 0.59 | 2.14 |
| 313 (invention) | C-1 as A + S-8 as D | 0.25 | 0.51 | 1.92 |
| 314 (invention) | C-1 as A + S-8 as D | 0.50 | 0.63 | 2.20 |

The photographic data for Sample 302 show that the high boiling solvent-free dispersion of cyan dye-forming coupler C-1 provides much lower gamma and upperscale density formation performance following direct substitution for the comparative control dispersion employing S-1, di-n-butylphthalate, in a weight ratio 1.0 to C-1 in the high, medium, and low sensitivity red-sensitive layers of color negative recording material of Example 301.The photographic data for Sample 303 show that the comparative high boiling solvent of the art, S-4, when combined with the solvent-free dispersion of cyan dye-forming coupler C-1 in a weight ratio of 1.0 during the preparation of the liquid coating solutions, gives an inferior sensitometric response. Comparative control examples 304 and 305 reveal that significantly reduced gamma and upperscale density formation performance follow diminution of the S-1 levels from the comparative control dispersion employing S-1 in a weight ratio 1.0 to C-1 in the high, medium, and low sensitivity red-sensitive layers of color negative recording material of Example 301.Comparative control Example 306 gives essentially the same result as Example 301, indicating that the method of combining the solvent-free dispersion of coupler C-1 with the dispersion of high boiling solvent S-1 in the liquid coating solutions of the slow, medium, and fast red-sensitive layers yields about the same performance as making a conventional dispersion of C-1 and S-1 at the normal ratio of 1.0.

All of the inventive Examples, 307–314, employing the high boiling solvents S-5, S-6, S-7, or S-8 at ratios of 0.25 or 0.50 of solvent to coupler, produce superior photographic performance in the aggregate of the gamma position and maximum density of the present characteristic curve relative to the solvent of the art S-1 under identical conditions of usage. In fact, solvents S-5, S-7; and S-8 in combination with C-1 give equivalent or superior gamma and density formation performance at a solvent/C-1 weight ratio of 0.50 as does S-1 at the usual ratio of 1.0 in comparative control Example 306.

| | | |
|---|---|---|
| di-n-butylphthalate | S-1 N,N-diethyllauramide | S-2 |
| N-n-butylacetanilide | S-3 tricresylphosphate | S-4 |
| oleyl alcohol (formula III-5) | S-5 phenylethylbenzoate (formula V-1) | S-6 |
| p-dodecylphenol (formula IV-1) | S-7 di-n-butylsebecate (formula II-1) | S-8 |
| 1,4-cyclohexylenedimethylenebis(2-ethylhexanoate) | S-9 | |

D-1

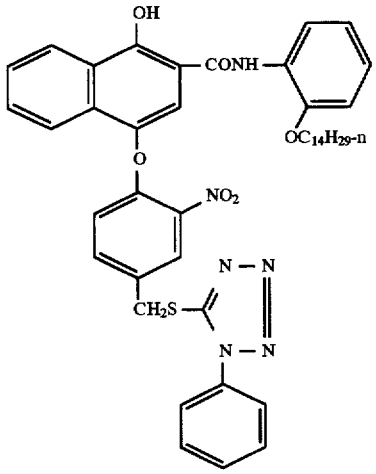

D-2

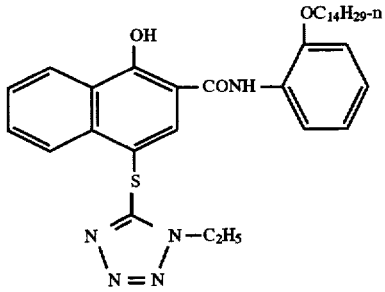

D-3

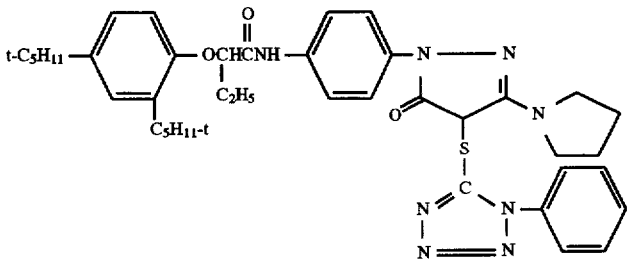

D-4

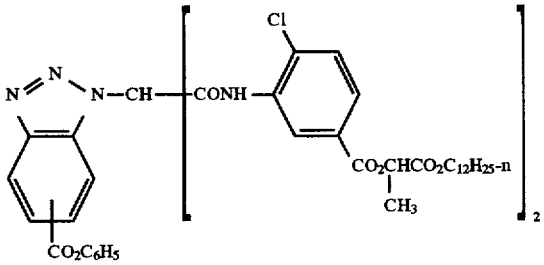

D-5

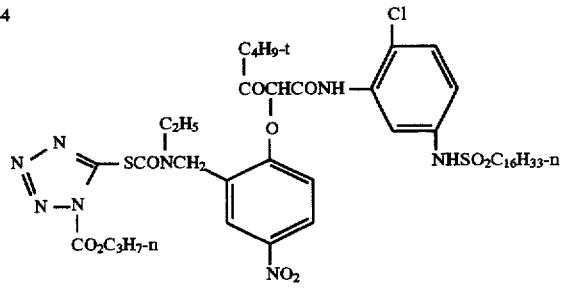

CM-1

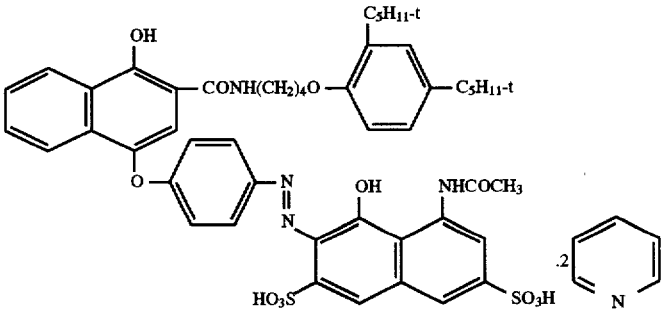

-continued
BAR-1
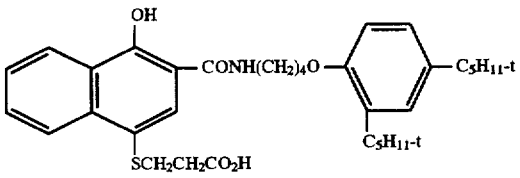
M-1
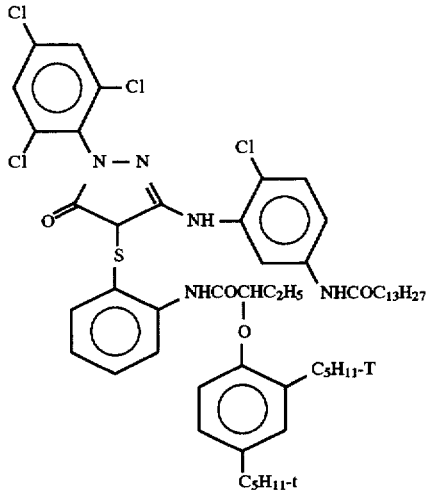
MM-1
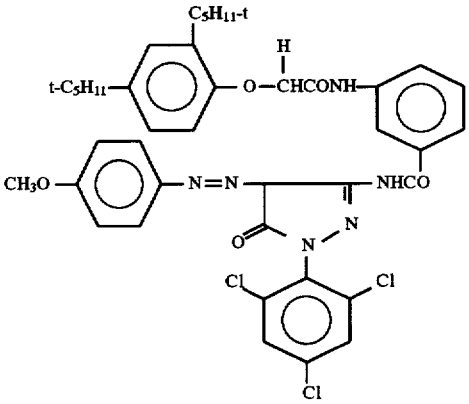
MM-2
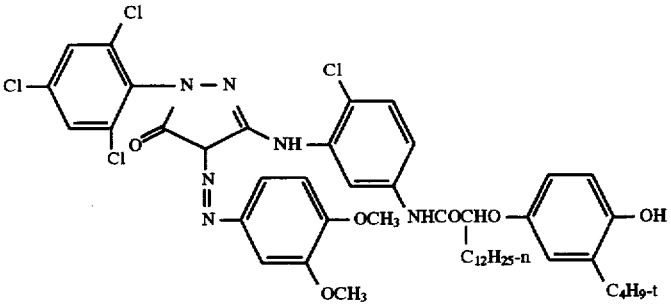
Y-1
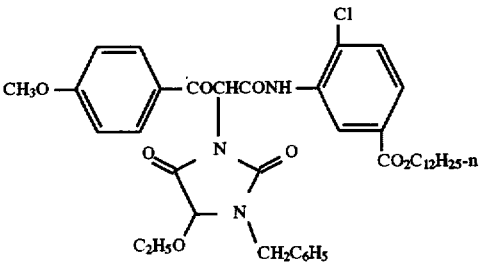
Y-2
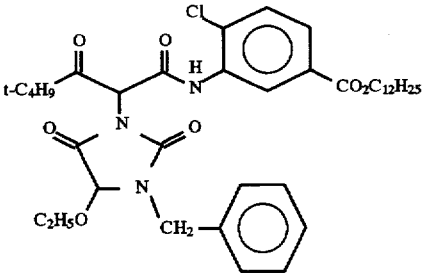

-continued
YD-1
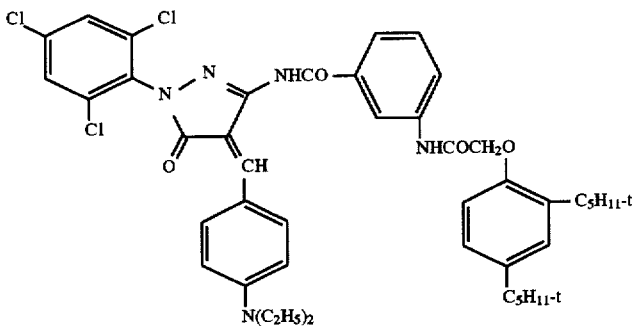
YD-2
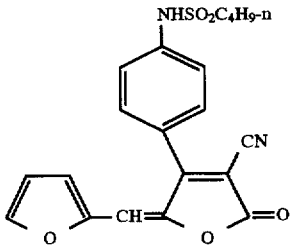
UV-1
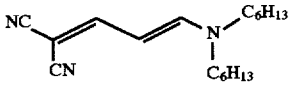
UV-2
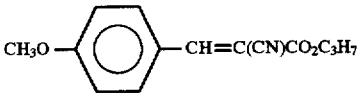
CD-1
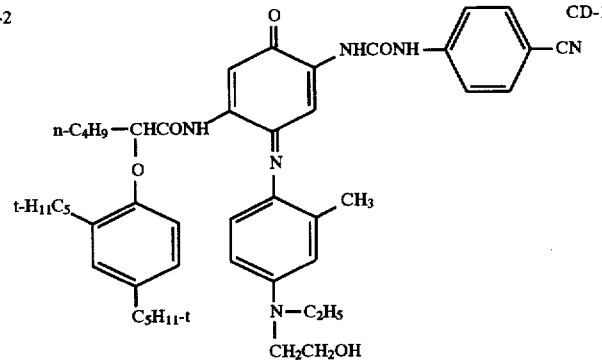
CD-2
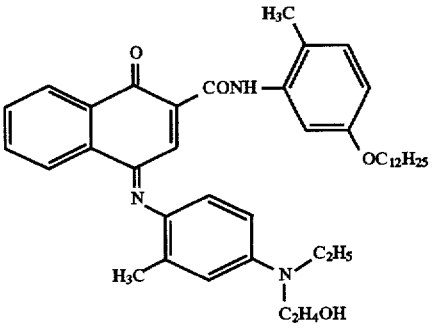
MD-1
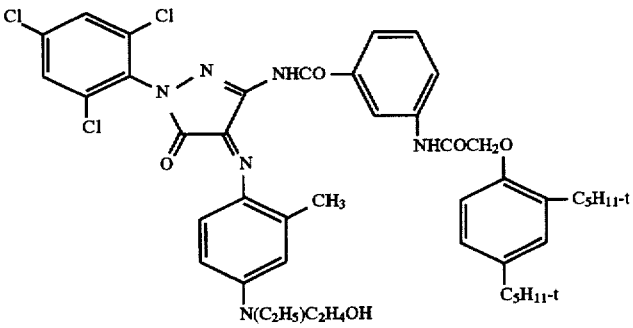

-continued

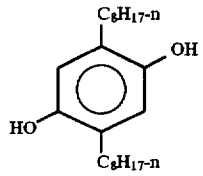

DOXS-1

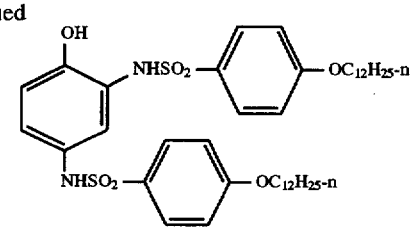

DOXS-2

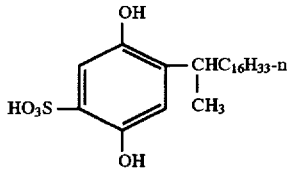

DOXS-3 bis(vinylsulfonyl) methane H-1

4-hydroxy-6-methyl-1,3,3a,7-tetraazaindene TAI

This invention has been described in detail with particular reference to preferred embodiments thereof. It will be understood that variations and modifications can be made within the spirit and scope of the invention.

What is claimed is:

1. A method of making a silver halide color photographic light sensitive material comprising:

(a) preparing a first dispersion of a phenolic cyan coupler of Formula I dispersed in an aqueous gelatin solution substantially free of permanent organic solvent;

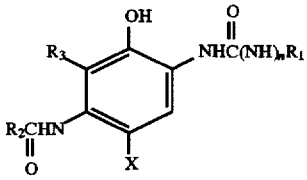

Formula I wherein $R_1$ and $R_2$ each represent an aliphatic group, an aromatic group, or a heterocyclic group, $R_3$ represents a hydrogen atom, a halogen atom, an aliphatic group, or an acylamino group, X represents a hydrogen atom or a group capable of being released upon a coupling reaction with oxidation product of a developing agent, and n represents 0 or 1;

(b) preparing a second dispersion of a high-boiling organic solvent having Formula II, III, IV, V or combinations thereof dispersed in an aqueous medium:

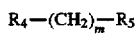

Formula II wherein $R_4$ and $R_5$ each represent an alkoxycarbonyl group containing not more than 8 carbon atoms, and m is an integer from 1 to 10;

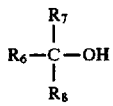

Formula III wherein $R_6$ represents an alkyl group or an alkenyl group, and $R_7$ and $R_8$ are individually selected from hydrogen and the group of moieties from which $R_6$ is selected, provided that the total number of carbon atoms contained in $R_6$, $R_7$, and $R_8$ is at least 10;

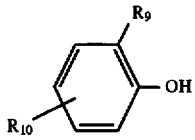

Formula IV wherein $R_9$ and $R_{10}$ are hydrogen or straight chain or branched chain alkyl groups, at least one of $R_9$ or $R_{10}$ being a straight chain or branched chain alkyl group, the total number of carbon atoms in $R_9$ plus $R_{10}$ being from 9 to 20, and $R_{10}$ being in the para or meta position with respect to the phenolic hydroxyl group;

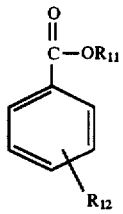

Formula V wherein $R_{11}$ represents an aliphatic group, an aromatic group, or a heterocyclic group, and $R_{12}$ represents a hydrogen atom, a hydroxy group, an alkoxy group, or an aliphatic group;

(c) combining said first and second dispersions in an aqueous coating solution, wherein the weight ratio in said coating solution of high-boiling organic solvent of formula II, III, IV and V relative to coupler of formula I is from 0.1 to 0.5; and (d) coating said coating solution on a photographic support.

2. A method according to claim 1, wherein n is 1.

3. A method according to claim 1, wherein $R_1$ is an aryl group substituted with one or more halogen atom, alkyl group, alkoxy group, aryloxy group, acylamino group, acyl group, carbamoyl group, sulfamido group, oxycarbonyl group or cyano group substituents.

4. A method according to claim 1, wherein $R_2$ is an alkyl group substituted with an aryloxy group.

5. A method according to claim 1, wherein n is 1 and X is a hydrogen atom, a halogen atom, or a aryloxy group.

6. A method according to claim 1, wherein the cyan coupler dispersion comprises dispersed particles which have an average particle size of from 0.02 mm to 2 mm.

7. A method according to claim 1, wherein the cyan coupler dispersion is formed by dissolving the coupler in an auxiliary solvent, dispersing the auxiliary solvent and dissolved coupler in an aqueous gelatin solution, and removing the auxiliary solvent from the dispersion.

8. A method according to claim 7, wherein the auxiliary solvent is a low boiling organic solvent and is removed by evaporation.

9. A method according to claim 1, wherein the cyan coupler dispersion comprises a single cyan coupler of Formula I substantially free of other cyan dye forming couplers.

10. A method according to claim 9, wherein the cyan coupler is of the following structure:

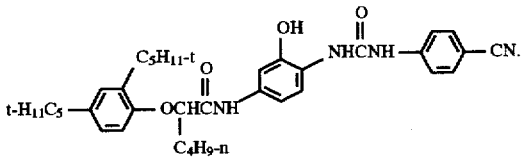

11. A method according to claim 1, wherein the cyan coupler is of the following structure:

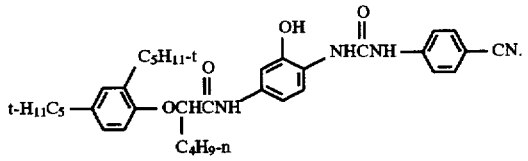

12. A method according to claim 1, wherein the weight ratio in said coating solution of high-boiling organic solvent of formula II, III, IV and V relative to coupler of formula I is from 0.1 to 0.35.

13. A method according to claim 1, wherein the high-boiling organic solvent is of Formula II.

14. A method according to claim 13, wherein the high boiling solvent is selected from the group consisting of dibutylsebacate, dioctylsebacate, bis (2-ethylhexyl) azelate, diethylsuberate, dibutyladipate, and dioctyladipate.

15. A method according to claim 1, wherein the high-boiling organic solvent is of Formula III.

16. A method according to claim 15, wherein the high-boiling organic solvent is selected from the group consisting of undecyl alcohol, dodecyl alcohol, oleyl alcohol, 2-hexyl-1-decanol, and hexadecanol.

17. A method according to claim 1, wherein the high-boiling organic solvent is of Formula IV.

18. A method according to claim 17, wherein the high-boiling organic solvent is selected from the group consisting of p-dodecylphenol, p-nonylphenol, and di-tert-pentylphenol.

19. A method according to claim 1, wherein the high-boiling organic solvent is of Formula V.

20. A method according to claim 19, wherein the high-boiling organic solvent is selected from the group consisting of phenylethylbenzoate, 2-ethylhexyl-p-hydroxybenzoate, and benzyl salicylate.

21. A method according to claim 1, wherein $R_1$ is an aryl group, $R_2$ is an alkyl group substituted with an aryloxy group, $R_3$ is a hydrogen atom, X is a hydrogen atom, n is 1, and the high-boiling organic solvent is selected from the group consisting of dibutylsebacate, undecyl alcohol, oleyl alcohol, p-dodecylphenol, and phenylethylbenzoate.

* * * * *